US005573481A

United States Patent [19]

Piercy et al.

[11] Patent Number: 5,573,481

[45] Date of Patent: Nov. 12, 1996

[54] FOOT OPERATED THERAPEUTIC DEVICE

[76] Inventors: William Piercy, Millbrook, Canada; Jean Piercy, legal representative, RR# 3, Millbrook, Ontario, Canada, L0A 1G0; Eric Whiteley, 611 Weller St., Peterborough, Ontario, Canada, K9J 4W8

[21] Appl. No.: 517,796

[22] Filed: Aug. 22, 1995

[51] Int. Cl.[6] ..... A63B 21/00

[52] U.S. Cl. ..... 482/57; 482/63

[58] Field of Search ..... 482/57, 51, 52, 482/53, 62, 63; 74/29, 45, 48, 53, 63; 280/259, 260

[56] References Cited

U.S. PATENT DOCUMENTS

| | | | |
|---|---|---|---|
| 2,641,249 | 6/1953 | Brockman | 482/57 |
| 3,081,645 | 3/1963 | Bergfors | 482/57 |
| 4,798,379 | 1/1989 | Jenkins | 482/53 |
| 5,324,241 | 6/1994 | Artigues et al. | 482/57 |
| 5,338,272 | 8/1994 | Sweeney | 482/57 |
| 5,496,238 | 3/1996 | Taylor | 482/57 |

*Primary Examiner*—Stephen R. Crow
*Attorney, Agent, or Firm*—Thomas A. O'Rourke

[57] ABSTRACT

Disclosed herein is a foot operated therapeutic exercise device comprising a saddle, a load and drive means to propel the load; the drive means further including a pair of pedal mechanisms, each of the pedal mechanisms including a pedal and a pedal support, the pedal support being mounted for rotation about a pedal axis; a pair of coupling means, each to independently couple a corresponding one of the pedals to the support in a manner to allow the position of the pedal to be adjusted relative to the pedal axis, according to the range of motion of a corresponding knee of a patient; adjustment means to independently adjust the pedal axis of each of the pedal mechanisms relative to the saddle, according to the corresponding leg of the patient, thereby allowing the exercise regimen for each leg to be adjusted according to its individual limitations.

15 Claims, 16 Drawing Sheets

FOOT OPERATED THERAPEUTIC DEVICE

BACKGROUND OF THE INVENTION

1. Field of the Invention

The present invention relates to therapeutic devices and more particularly to therapeutic devices for leg therapy.

2. Description of the Related Art

The advances of medical science continue to create procedures to improve the lifestyle of mankind. Artificial joint technology has given those suffering from joint diseases a new lease on a mobile lifestyle.

With these new developments in procedures come new rehabilitation techniques to allow patients to gradually improve their mobility following surgery. For example, a patient may have, one knee with much less mobility than the other. Initial bending of the knee may be very limited and therapy may consist of manual manipulation of the leg, while normal walking or use of a standard exercise bicycle is out of the question. This is due to the fact that a standard exercise bicycle is only capable of exercising each leg the same extent. Thus, conventional therapeutic devices lack the ability to exercise one leg differently than the other.

It is an object of the present invention to obviate these difficulties.

SUMMARY OF THE INVENTION

Briefly stated the invention involves a foot operated therapeutic exercise device comprising;

a saddle, a load and drive means to propel the load;

the drive means further including a pair of pedal mechanisms, each of the pedal mechanisms including a pedal and a pedal support, the pedal support being mounted for rotation about a pedal axis;

a pair of coupling means, each to independently couple a corresponding one of the pedals to the support in a manner to allow the position of the pedal to be adjusted relative to the pedal axis, according to the range of motion of a corresponding knee of a patient;

adjustment means to independently adjust the pedal axis of each of the pedal mechanisms relative to the saddle, according to the corresponding leg of the patient, thereby allowing the exercise regimen for each leg to be adjusted according to its individual limitations.

In another aspect of the present invention, there is provided a method of providing therapeutic exercise comprising the steps of;

providing a saddle, a load and drive means to propel the load;

providing the drive means with a pair of pedal mechanisms, each of the pedal mechanisms including a pedal and a pedal support;

mounting the pedal support for rotation about a pedal axis;

coupling the pedal to the support in a manner to allow the position of the pedal to be adjusted relative to the pedal axis according to the range of motion of a corresponding knee of a patient; and adjusting the pedal axis relative to the saddle according to the corresponding leg of the patient, thereby allowing the exercise regimen for each leg to be adjusted according to its individual limitations.

BRIEF DESCRIPTION OF THE DRAWINGS

Several preferred embodiments of the present invention will now be described, by way of example only, with reference to the appended drawings in which.

DESCRIPTION OF THE PREFERRED EMBODIMENTS

Figure 1:
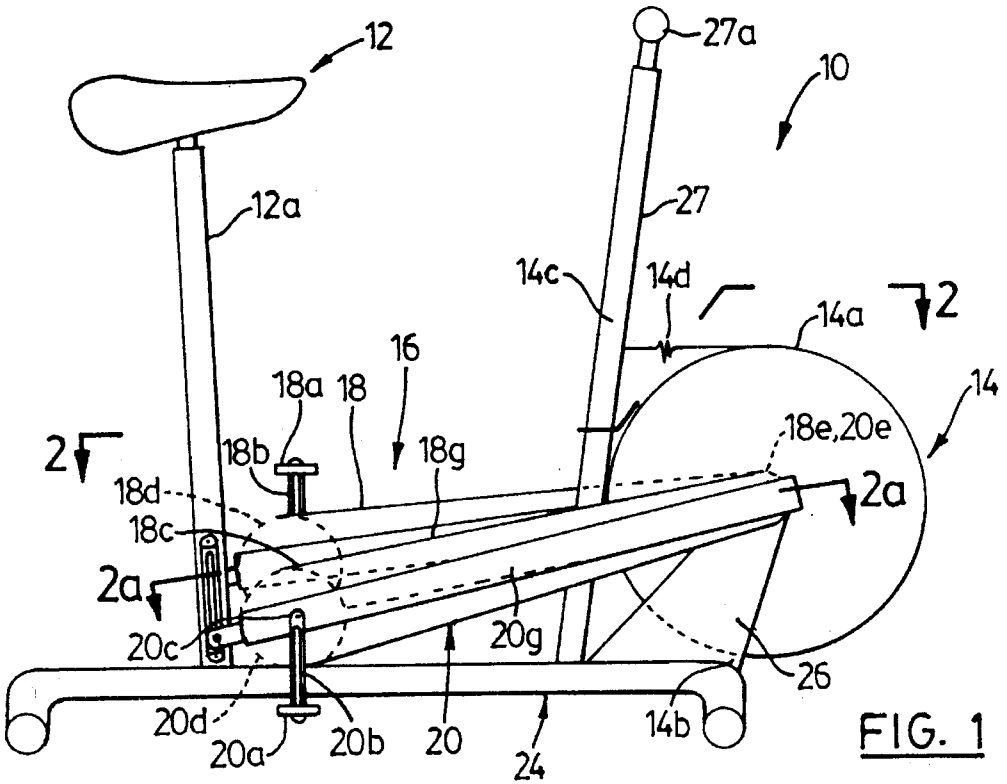
FIG. 1 is a side view of a foot operated therapeutic exercise device.
Figure 2:
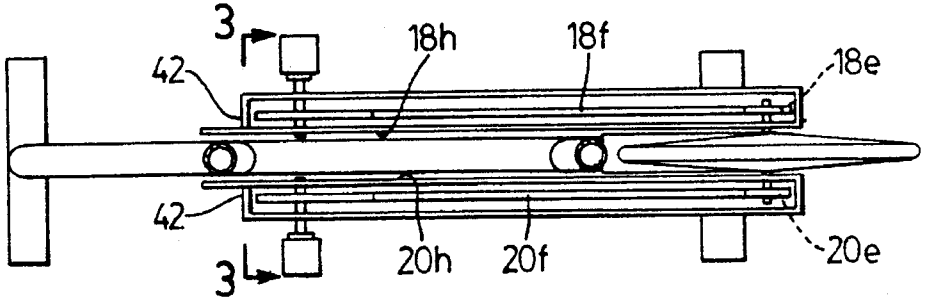
FIG. 2 is a sectional view taken on line 2—2 of FIG. 1.
Figure 3:
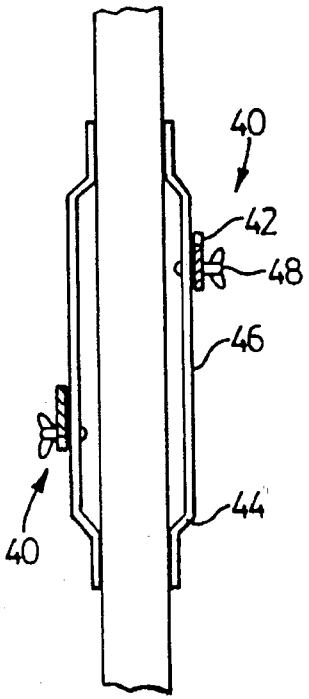
FIG. 3 is a fragmentary sectional view taken on line 3—3 of FIG. 2.

Referring to FIGS. 1 to 3, there is provided a foot operated therapeutic exercise device 10 comprising a saddle 12, a load in the form of a rotationally mounted load wheel 14 and drive means 16 to propel the load wheel 14. The drive means further includes a pair of pedal mechanisms 18, 20. Each pedal mechanism includes a pedal 18*a*, 20*a* and a pedal support arm 18*b*, 20*b*, the pedal support being mounted for rotation about a respective pedal axis 18*c*, 20*c*. The pedals are fixed to a respective drive sprocket 18*d*, 20*d* which drive a respective driven sprocket 18*e*, 20*e* (FIG. 2) by way of a respective transmission member in the form of a chain 18*f*, 20*f*.

The saddle 12 is positioned on a vertically adjustable saddle support 12*a* which is joined to a base frame 24 extending the length of the device, thereby to support the saddle, the load and the drive means. A front support frame 26 provides the location for and supports the load wheel 14. A front handle bar support 27 supports the handle bar 27*a* and extends upwardly from the base frame 24. A pair of independent drive support frames 18*g*, 20*g* independently support the pedal mechanisms 18, 20.

Figure 2A:
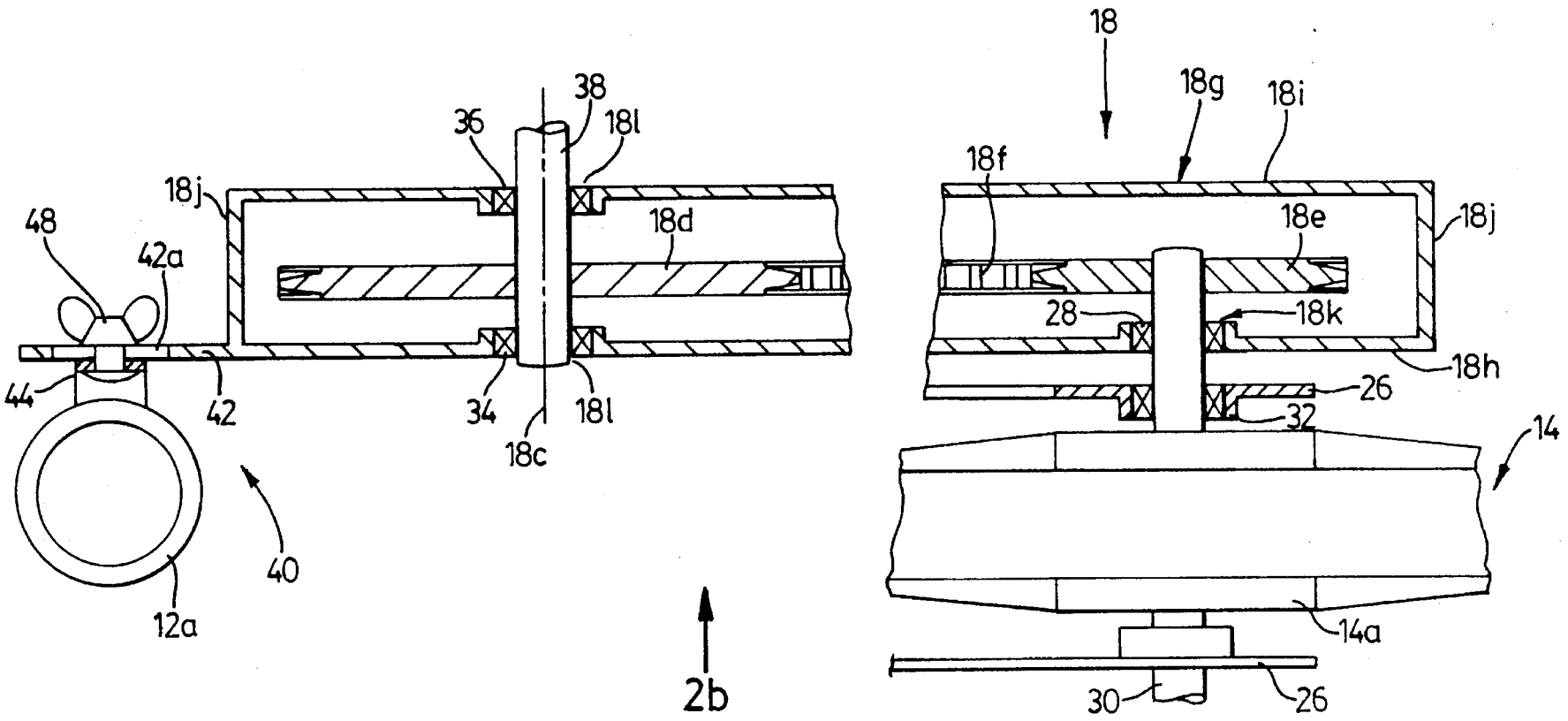
FIG. 2*a* is a magnified fragmentary view, also taken on line 2*a*—2*a* of FIG. 1.

Referring more particularly to FIG. 2*a*, the drive support frame 18*g* has an inner frame member 18*h* and an outer frame member 18*i* which are integrally formed at their respective ends by way of transverse frame members 18*j*. The front end of the inner frame member is provided with a passage 18*k* to receive a bearing 28 which in turn supports a common load axle 30, itself fixed for rotation with the driven sprocket 18*e*. The common load axle 30 locks the two pedal mechanisms with the pedals in the usual opposite positions as shown in FIG. 1 and is also supported by a bearing 32 mounted in the front support frame 26 and is fixed for rotation with the hub 14*a* of the load wheel 14. The rear ends of both the inner and outer frame members are also provided with passages 181 to receive bearings 34, 36 which in turn support a pedal axle 38, itself fixed for rotation with the drive sprocket 18*d*. In this manner, each drive support frame supports the rear axle and is supported at the front by the load wheel axle, while providing the necessary stiffness to maintain a chain tightly engaged with both sprockets.

Referring to FIGS. 2*a* and 3, a pair of adjustment means are provided at 40 to independently adjust the pedal axis of each of the pedal mechanisms relative to the saddle, according to the corresponding leg of the patient. For example, the pedal axis of each pedal mechanism may be adjusted according to the effective length of the leg of the patient, which of course can vary according to the patients height and the limitations imposed on each leg. The leg might be limited to movement in a fully extended position, a partially bent or fully bent condition at the knee, or in some other configuration.

The adjustment means 40 include a pair of flange members 42, each extending rearwardly from a corresponding inner frame member 18*h*, 20*h*. The flange members 42 are aligned with corresponding guide members 44 extending along a length of the saddle support and which have an elongate passage 46. Each elongate passage is in turn respectively aligned with a bore in each of the flange members identified at 42*a*, so as to receive a threaded fastener therethrough as shown at 48.

Figure 2B:
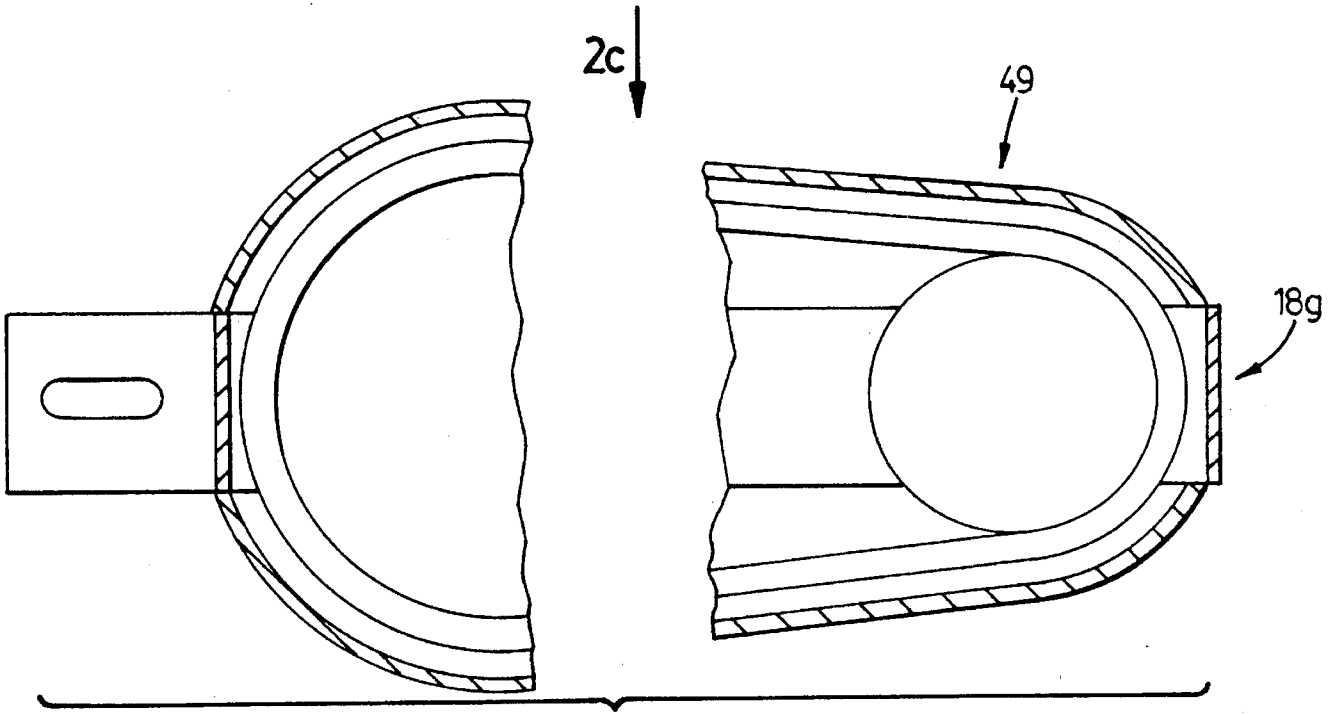
FIG. 2*b* is a fragmentary sectional view taken on line 2*b*—2*b* of FIG. 2*a;*
Figure 2C:
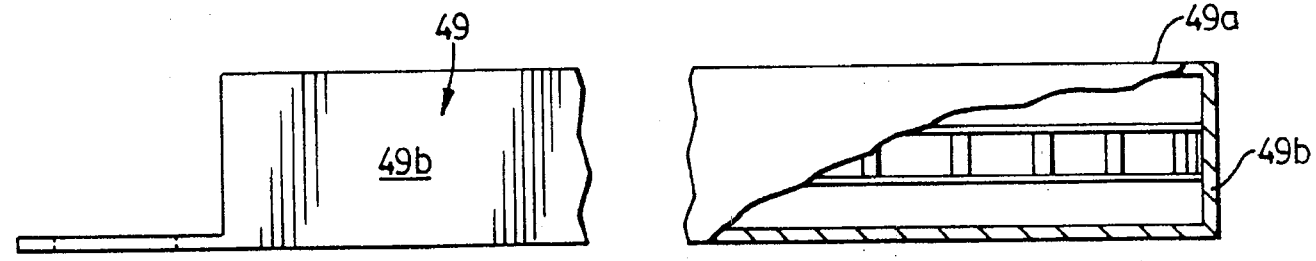
FIG. 2*c* is a fragmentary part sectional view taken on arrow 2*c* of FIG. 2*b;*

Referring to FIGS. 2*b* and 2*c*, each pedal mechanism also includes a guard 49 for the sprockets and chains and which is removably coupled to the drive support frame to protect the patient from injury and to contain lubricants used on the chain and sprockets. The guard 49 includes a back wall portion 49*a* and a side wall portion 49*b* extending around the outer periphery of the wall portion 49*a*.

Referring to FIGS. 1 and 2, the load wheel 14 further includes a resistive device such as a belt extending the circumference of the wheel as shown at 14*a* which is anchored to the frame 26 by way of pin 14*b* and anchored to the front handle bar support 27 by way of pin 14*c*. Also provided is a spring shown at 14*d* to moderate the friction exerted on the wheel by the belt 14*a*. Other modes of resistance may be suitable including the use of a load roller pressed against the load wheel.

Figure 5:
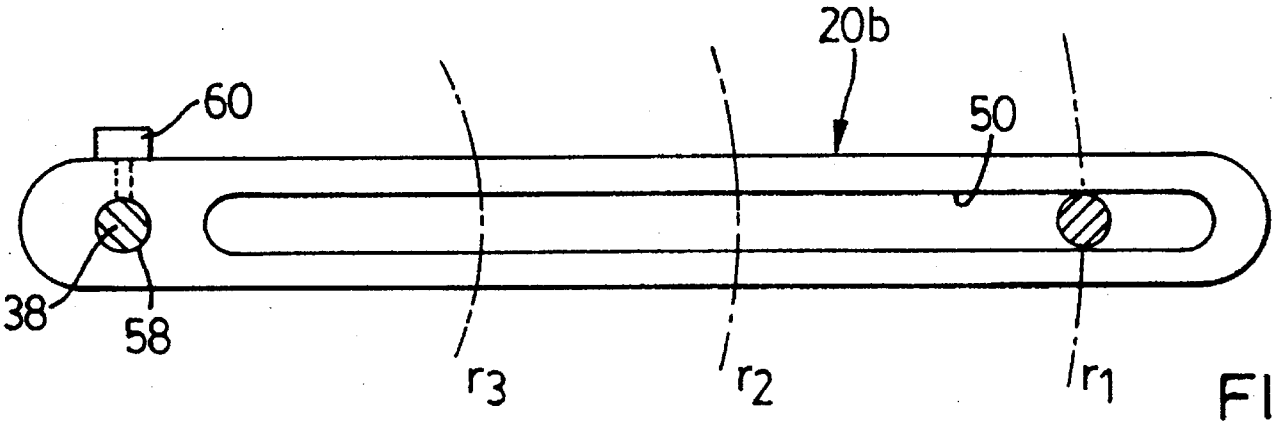
FIG. 5 is a sectional view taken on line 5—5 of FIG. 4.
Figure 4:
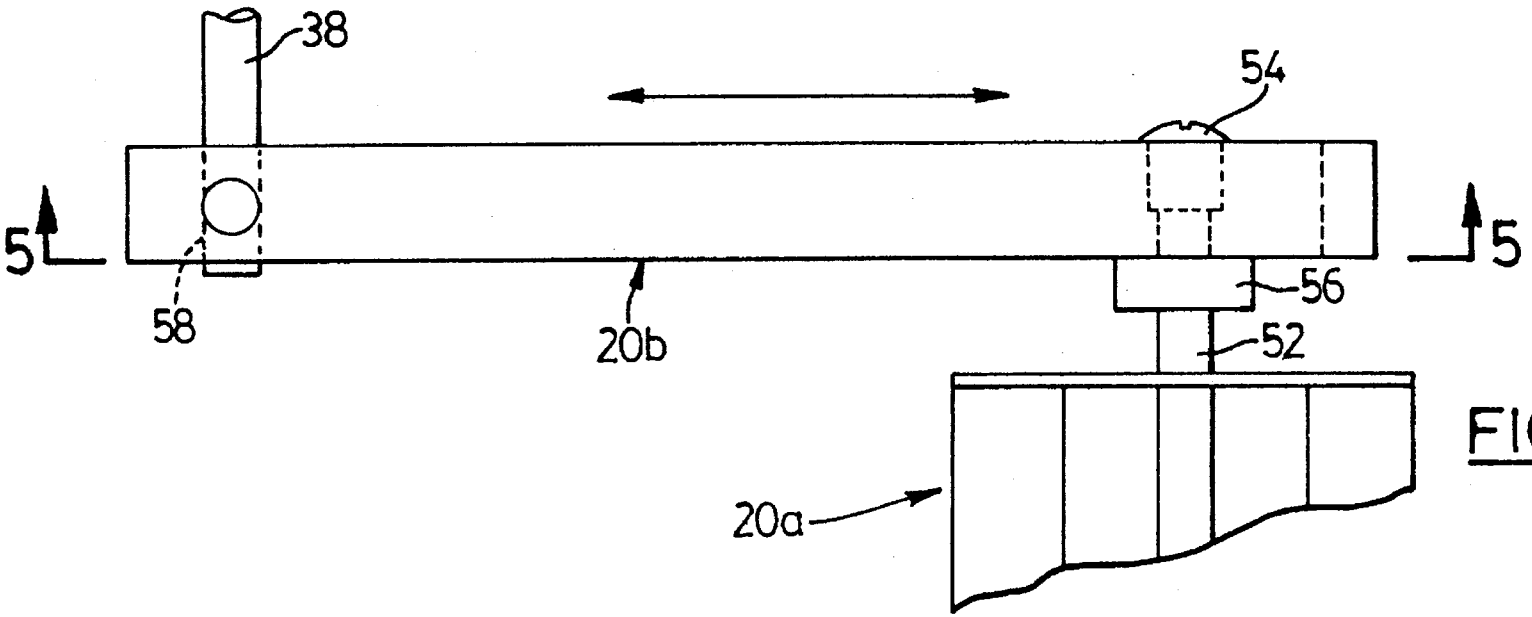
FIG. 4 is a plan view of another portion of the device illustrated in FIG. 1.

Referring to FIGS. 4 and 5, a pair of coupling means are also provided to independently couple a corresponding one of the pedals to its pedal support in a manner to allow the position of the pedal to be adjusted relative to the pedal axis, according to the range of motion of a corresponding leg of a patient, thereby allowing the exercise regimen for each leg to be adjusted according to its individual limitations. In other words, one knee with limited mobility may be accommodated by bringing the pedal closer to its pedal axis. This can be seen in FIGS. 4 and 5 wherein each pedal support arm 20*b* is provided with an elongate passage 50 and the pedal 20*a* is provided with a pedal shaft 52 which extends through passage 50 and is slidable therein. The pedal shaft in turn may be secured in position as desired along the length of the passages by way of threaded fasteners 54, 56. The pedal support is also provided with a bore 58 to receive a respective drive axle 38 therethrough, which in turn can be secured in place by a fastener shown at 60. The pedal axis shaft is fixed to the drive sprocket 20*d*.

In this manner, the pedal axis of each pedal mechanism is provided by a discrete pedal axle and each of the pedal supports includes a pedal support arm, the arm having one end which is fixed to the discrete pedal axle. Each pedal is coupled to its respective arm by way of a pedal coupling means so that the pedal is able to follow a radius of curvature about the axis, such as shown by $r_1$, $r_2$ and $r_3$ and thereby allows the position of the pedal to be varied along the arm.

Figure 6:
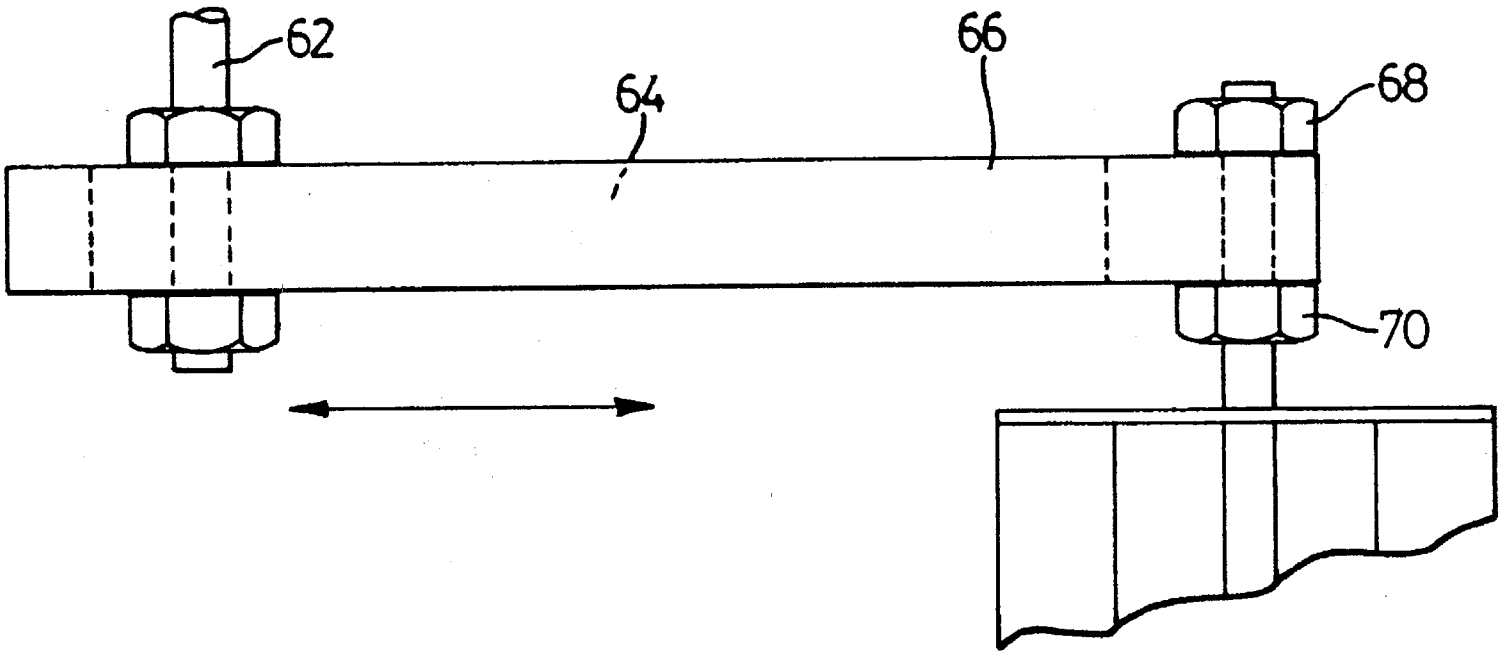
FIG. 6 is a plan view of an alternative to the portion illustrated in FIG. 4.

Referring to FIG. 6, the pedal axle 62 of each pedal mechanism may alternatively be slidably mounted in the elongate passage 64 of the corresponding pedal support arm 66 with the pedal fixed to the other end of the pedal support arm by two threaded fasteners 68, 70.

Figure 6A:
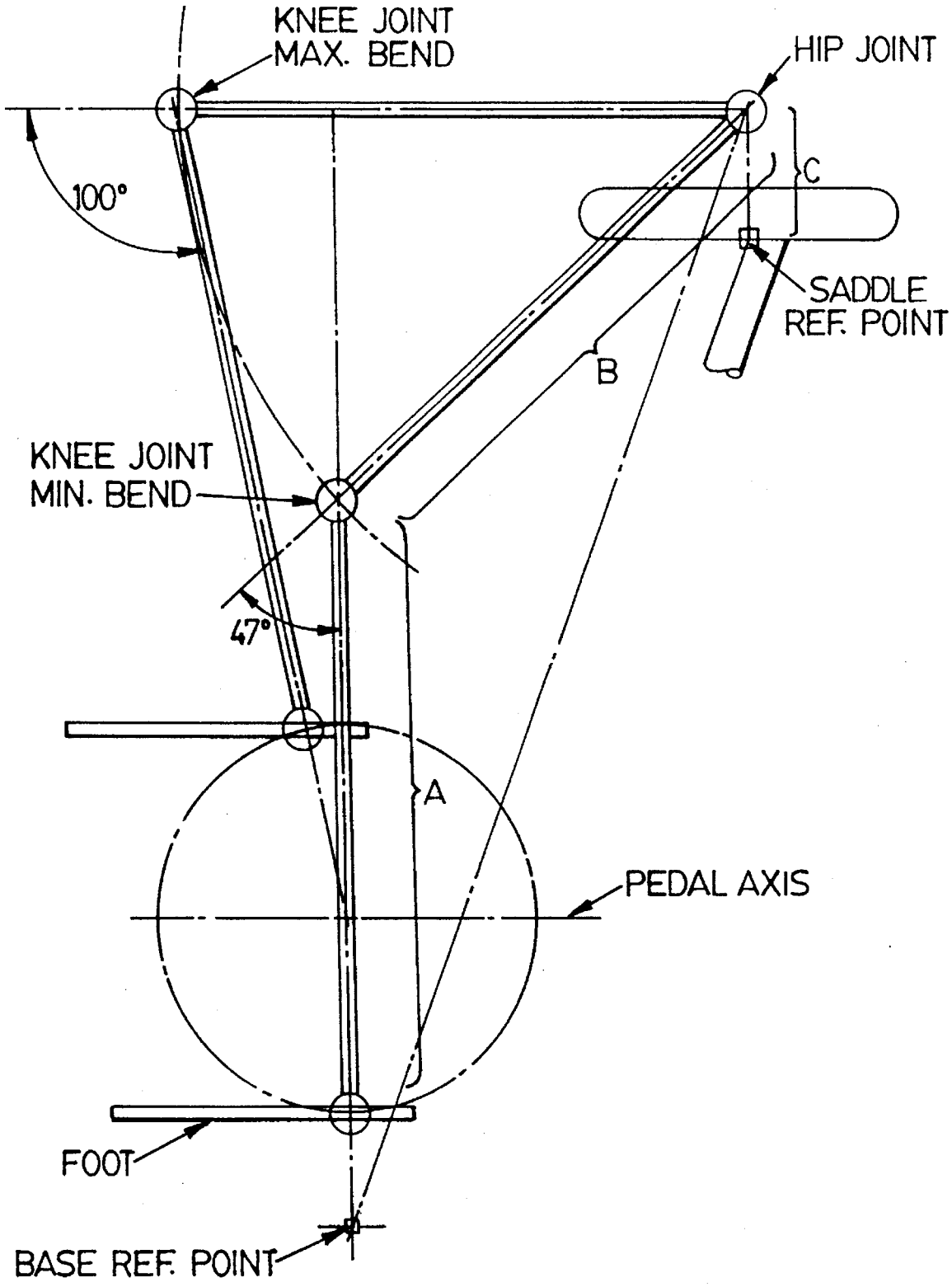
FIG. 6*a* is a schematic view of the device illustrated in FIG. 1 in one operating configuration.
Figure 6B:
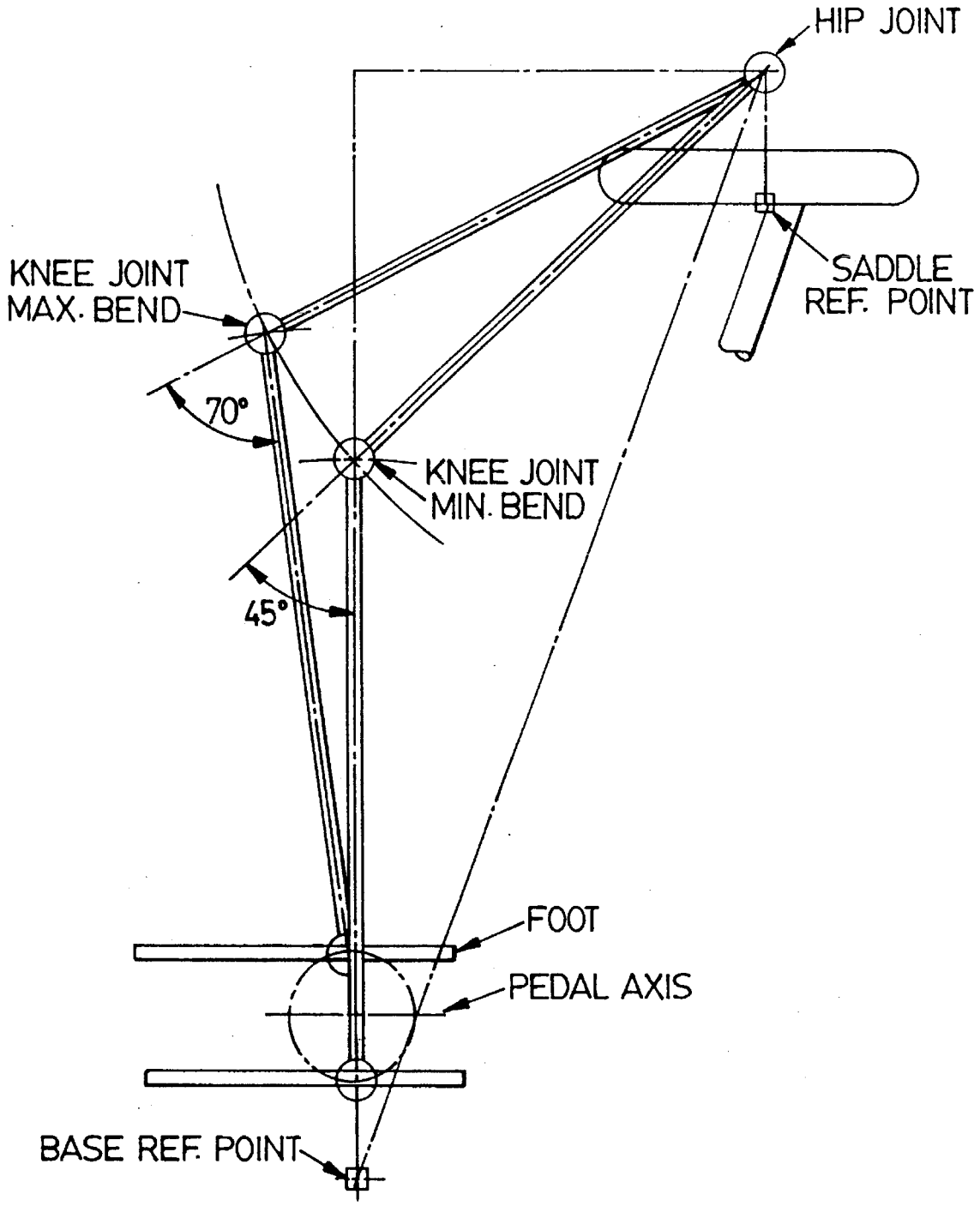
FIG. 6*b* is a schematic view of the device illustrated in FIG. 1 in another operating configuration.

Before discussing the operation of the device 10 in particular, reference is made to FIGS. 6*a* and 6*b* which show schematic views of the configuration of a typical patient's leg, including the measured length of a patient's leg bone from the sole of the foot to the centre of the knee joint, identified at 'A', and the length of the hip bone from the centre of the knee joint to the centre of the hip joint as identified at 'B'. There is also a dimension for the thickness of a patient's buttocks from the centre of the hip joint to a reference point of the saddle when seated on the saddle, as identified at 'C'. An average patient might have a height of 68 inches, a leg-bone length of 19 inches and a hip-bone length of 17 inches. The saddle to hip joint dimension could be 4 inches. To simplify this model, the usual flexing of the foot at the ankle joint when riding the device may be neglected.

Accordingly, the device 10 may be adjusted to take into account the parameters of the patient. For example, the patient's left leg may have limited mobility as might for example be the result of a knee or hip replacement surgery, leg muscle or tendon surgery or the like, while the patient's right leg may have normal mobility. In this case, the limited leg as shown in FIG. 6*b* may be accommodated by setting the corresponding pedal relatively close to its axis of rotation while leaving the other pedal at its remote position or alternatively at a position according to the mobility of the right leg as shown in FIG. 6*a*. The patient may then operate the device in the conventional fashion by applying a downward force on the downward travelling pedal. As the limited movement knee improves, the corresponding pedal may be adjusted accordingly.

The device 10 is first adjusted to accommodate the needs of the patient. Using the above example, the device 10 may be adjusted with the left pedal mechanism higher than the right, perhaps with the left pedal being positioned relatively close to its respective pedal axis, that is as shown at $r_3$. With the seat, the handle bar and the load wheel resistance set, the patient may then be installed on and be encouraged to pedal the device. Adjustments may then be made periodically through the exercise program to reflect the progress of the exercise therapy, such as by moving the left pedal from its position at $r_3$ to a new position $r_2$ as the patient gains greater mobility.

Figure 7:
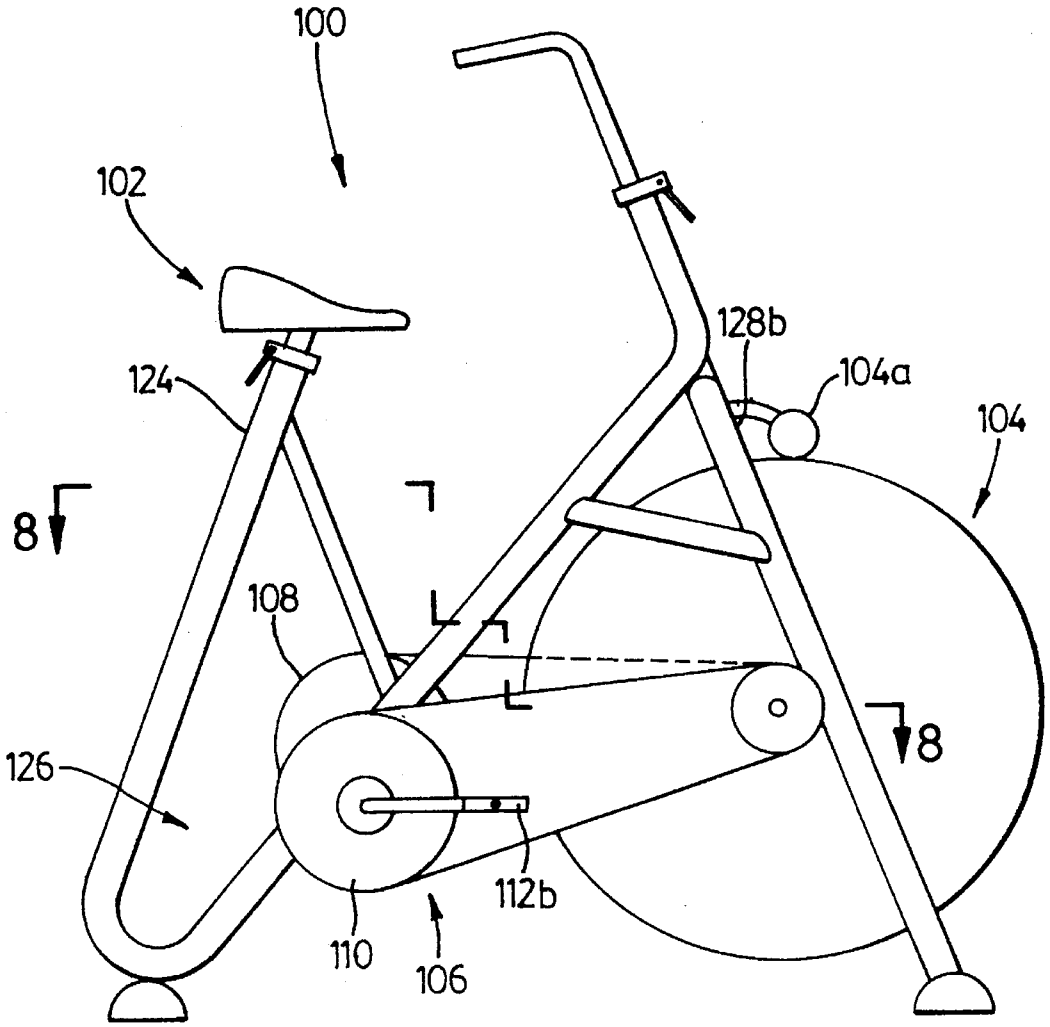
FIG. 7 is a side view of another foot operated therapeutic exercise device.
Figure 8:
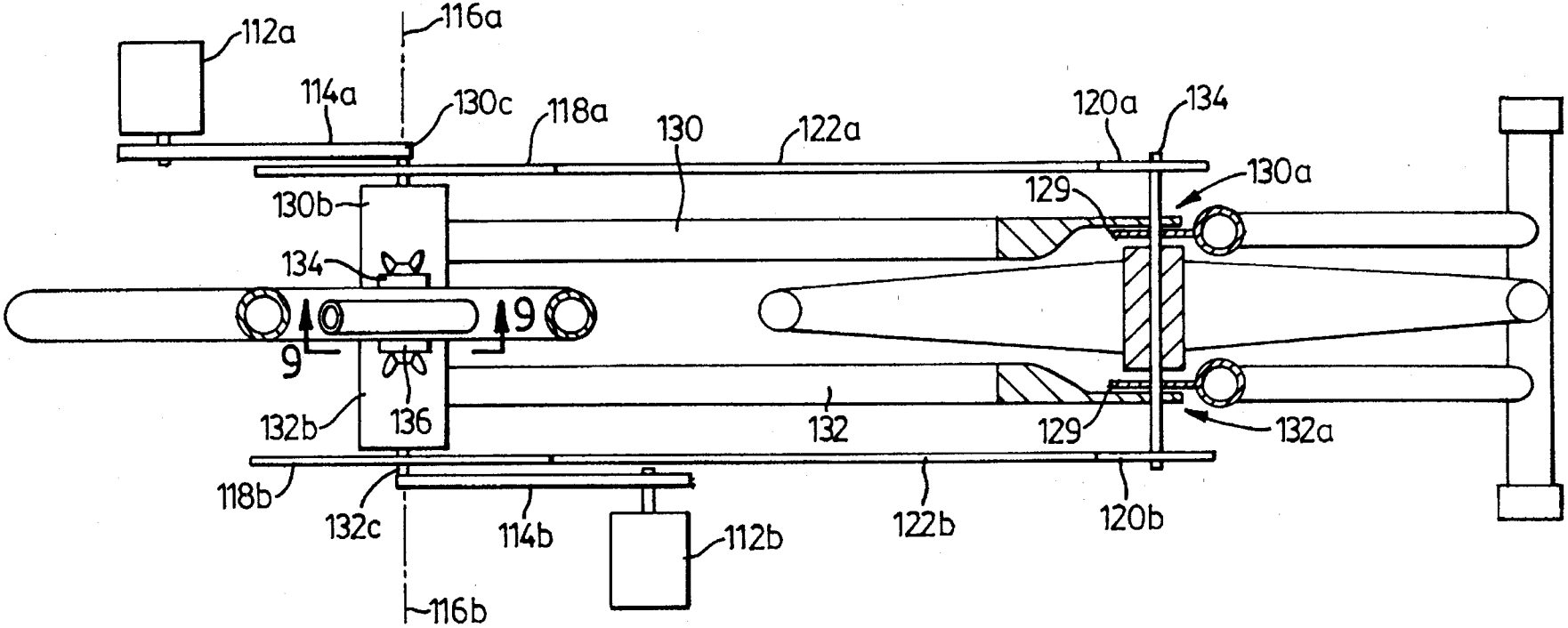
FIG. 8 sectional view taken on line 8—8 of FIG. 7.

Referring generally to FIGS. 7 to 10 and more particularly to FIGS. 7 and 8, there is provided another foot operated therapeutic exercise device 100 comprising a saddle 102, a load in the form of a rotationally mounted load wheel 104 and drive means 106 to propel the load wheel 104. The drive means further includes a pair of pedal mechanisms 108, 110. Both pedal mechanisms include a pedal 112*a*, 112*b* and a pedal support arm 114*a*, 114*b*, the pedal support being mounted for rotation about a respective pedal axis 116*a*, 116*b*. The pedals are fixed to a respective drive sprocket 118*a*, 118*b* which drive a respective driven sprocket 120*a*, 120*b* by way of a respective transmission member in the form of a chain 122*a*, 122*b*.

The saddle 102 is positioned on a vertically adjustable saddle support 124 which in this case forms part of a base frame 126, thereby to support the saddle, the load and the drive means. A pair of front support frame members 128*a*, 128*b* provide the location for and support the load wheel 104 as well as a resistive device, in this case in the form of a conventional adjustable load roller 104*a*. A pair of flange members 129 extend rearwardly from the front support frame members and each is provided with a passage 129*a* to extend a common load axle 134 therethrough. A pair of independent drive support frames 130, 132 independently support the pedal mechanisms 108 and 110.

Figure 9:
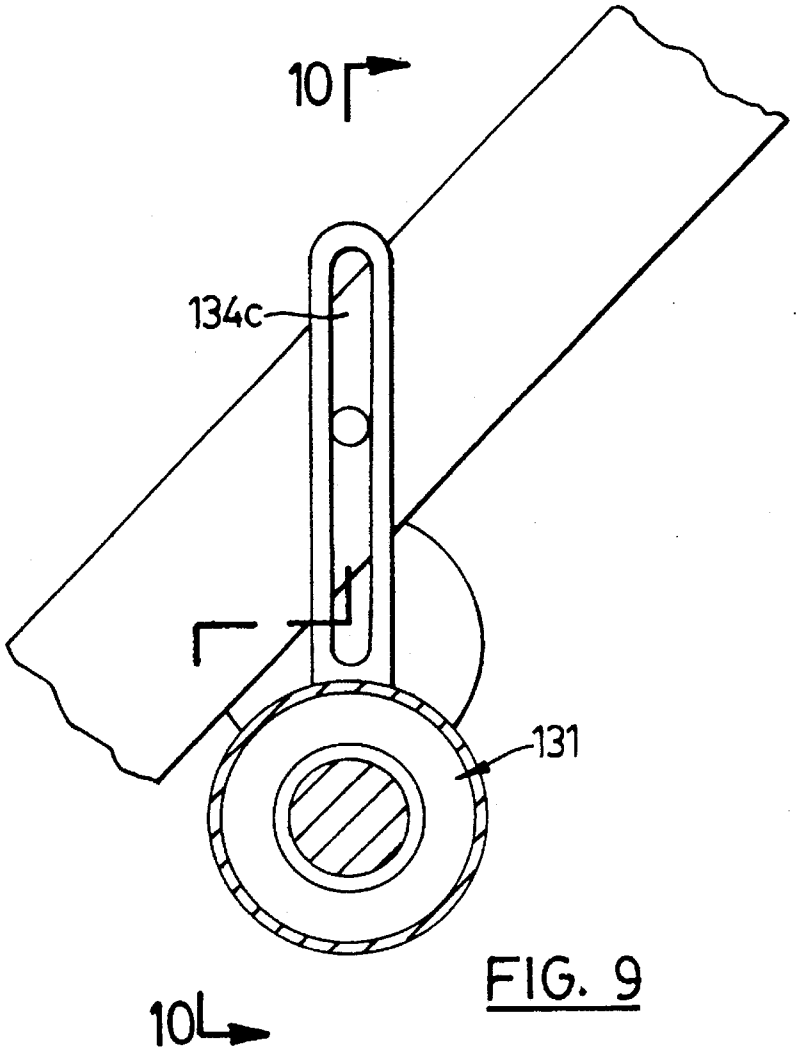
FIG. 9 is a fragmentary sectional view taken on line 9—9 of FIG. 8.
Figure 10:
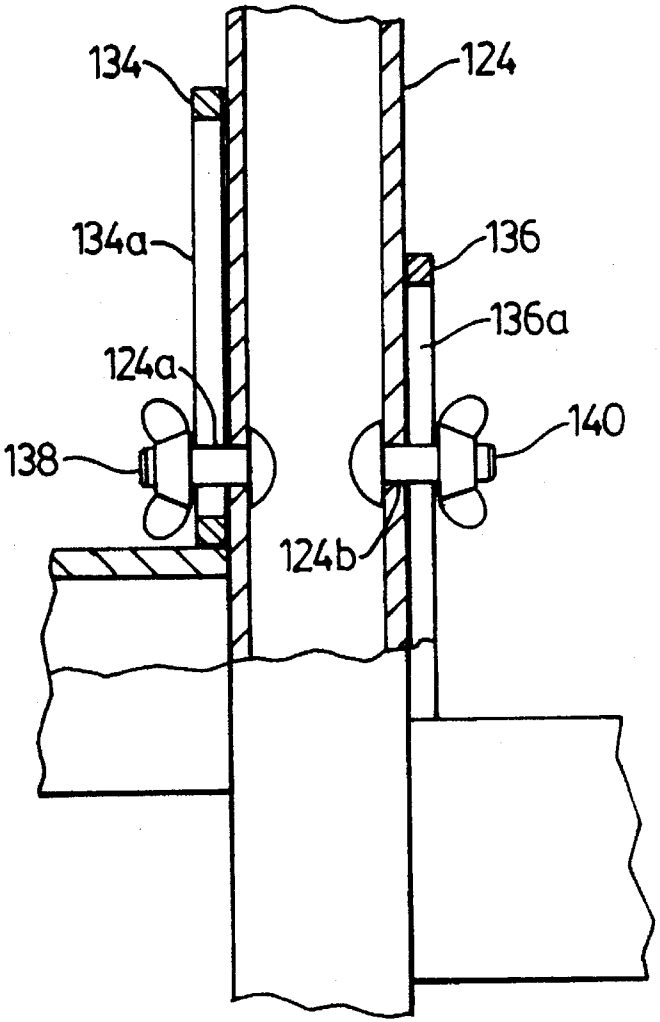
FIG. 10 is a fragmentary end view taken on arrow 10 of FIG. 9.

Referring to FIGS. 8, 9 and 10, the support frames 130, 132 each include a front end 130*a*, 132*a* which is provided with a passage to receive the common load axle 134 therethrough and which is fixed to each of the driven sprockets 120*a*, 120*b*. The support frames 130, 132 each also include a rear bearing housing 130*b*, 132*b* with a bearing assembly generally shown at 131 to support a respective drive axle shown at 130*c* and 132*c*, themselves fixed to a respective drive sprocket 118*a*, 118*b*. Extending upwardly from each rear bearing housing 130*b*, 132*b* is a slotted adjustment member 134, 136 whose slots 134*a*, 136*a* are aligned with respective passages 124*a*, 124*b* in the saddle support 124. Threaded fasteners 138, 140 extend through the aligned passages and slots to retain the independent pedal supports in a desired elevation relative to the saddle.

In use, the device 100 is first adjusted to accommodate the needs of the patient. Using the above example again, the device 100 may be adjusted with the left pedal mechanism higher than the right, perhaps with the left pedal being positioned relatively close to its respective pedal axis, that is as shown at $r_3$. With the seat, the handle bar and the load wheel resistance set, the patient may then be installed on and be encouraged to pedal the device. Adjustments may then be made periodically through the exercise program to reflect the progress of the exercise therapy, such as by moving the left pedal from its position at $r_3$ to a new position $r_2$ as the patient gains greater mobility.

Figure 11:
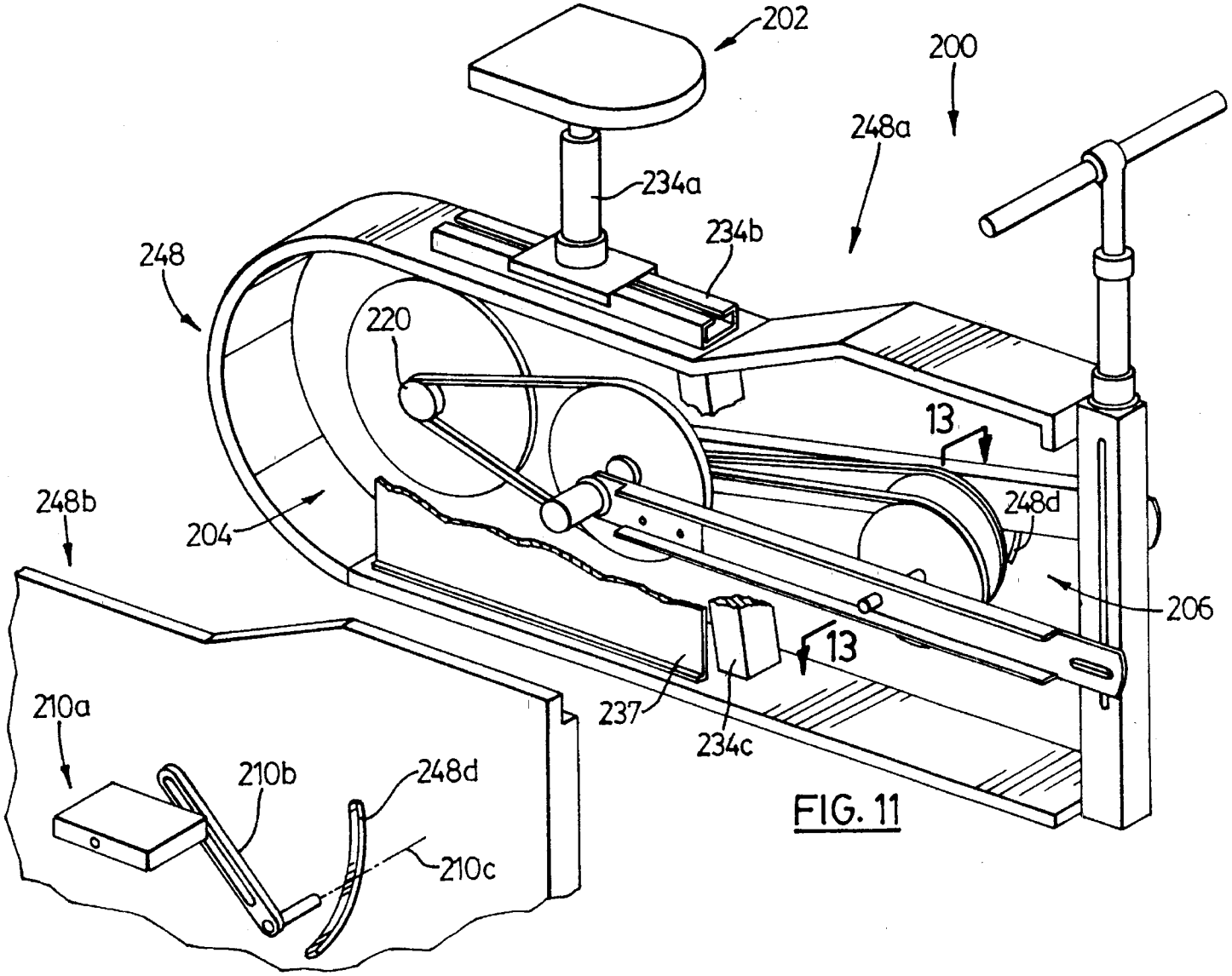
FIG. 11 is a fragmentary perspective view of still another foot operated therapeutic exercise device.

Referring generally to FIGS. 11 to 16 and more particularly to FIG. 11, another foot operated therapeutic exercise device is shown at 200, comprising a saddle 202, a load assembly 204, and drive means 206 to propel the load assembly 204. The drive means is positioned in the forward region of the device while the load assembly is located in the rearward region and generally beneath the saddle.

Figure 12:
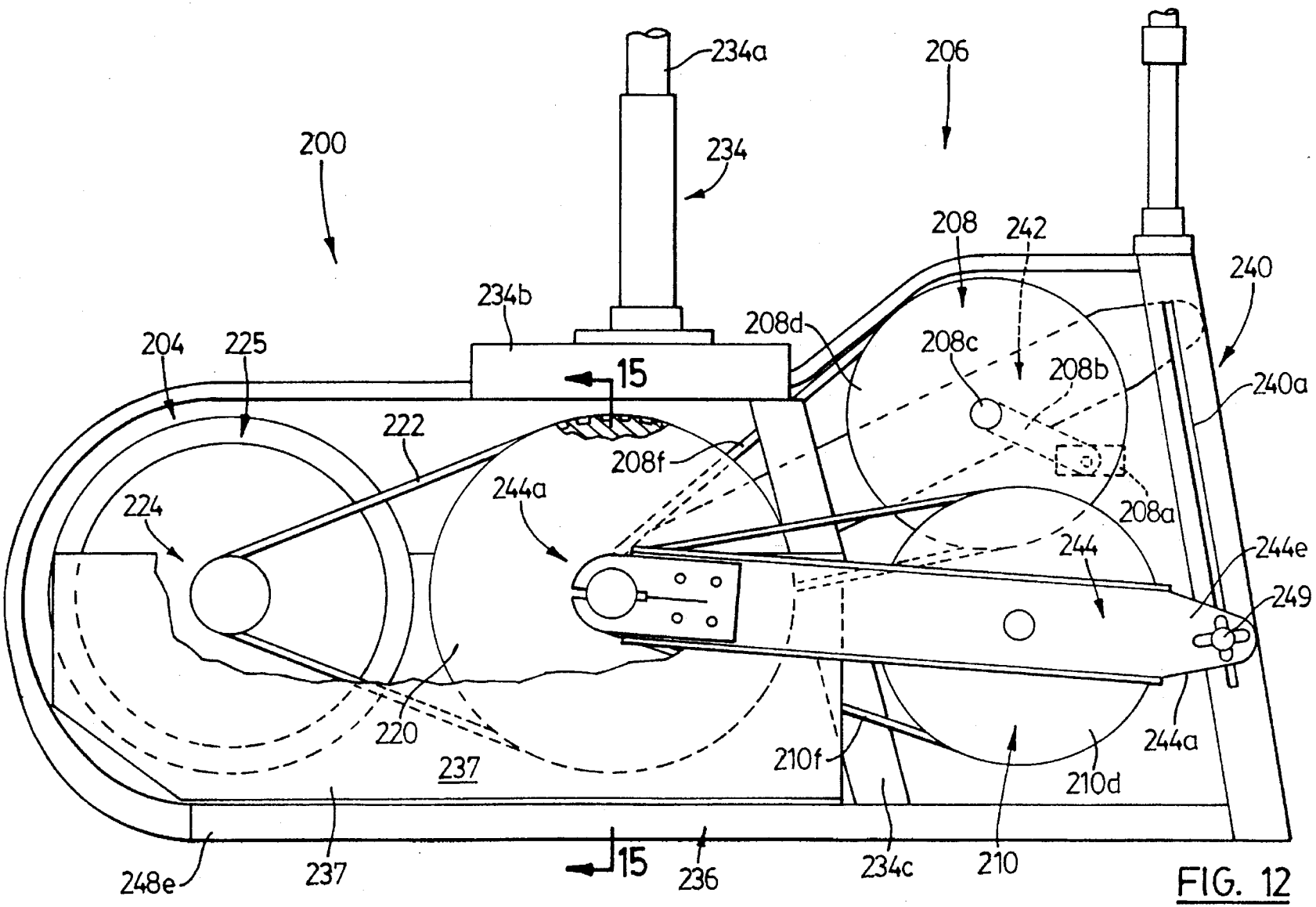
FIG. 12 is a fragmentary side view of a portion of the device illustrated in FIG. 11.

Referring to FIG. 12, the drive means further includes a pair of pedal mechanisms 208, 210. As will be shown, each of the pedal mechanisms further includes one of a pair of transmission members, to deliver power from each of the pedal mechanisms to a common load axle. The common load axle further comprises a pair of common load axle portions, each of which is coupled to a corresponding transmission member.

Each of the pedal mechanisms include a pedal 208*a*, 210*a* and a pedal support arm 208*b*, 210*b*, the pedal support being mounted for rotation about a respective pedal axle 208*c*, 210*c*. The pedal axles are fixed to a respective drive sprocket 208*d*, 210*d* which drive a respective driven sprocket 208*e*, 210*e* by way of a respective transmission member in the form of a chain 208*f*, 210*f*.

Figure 15:
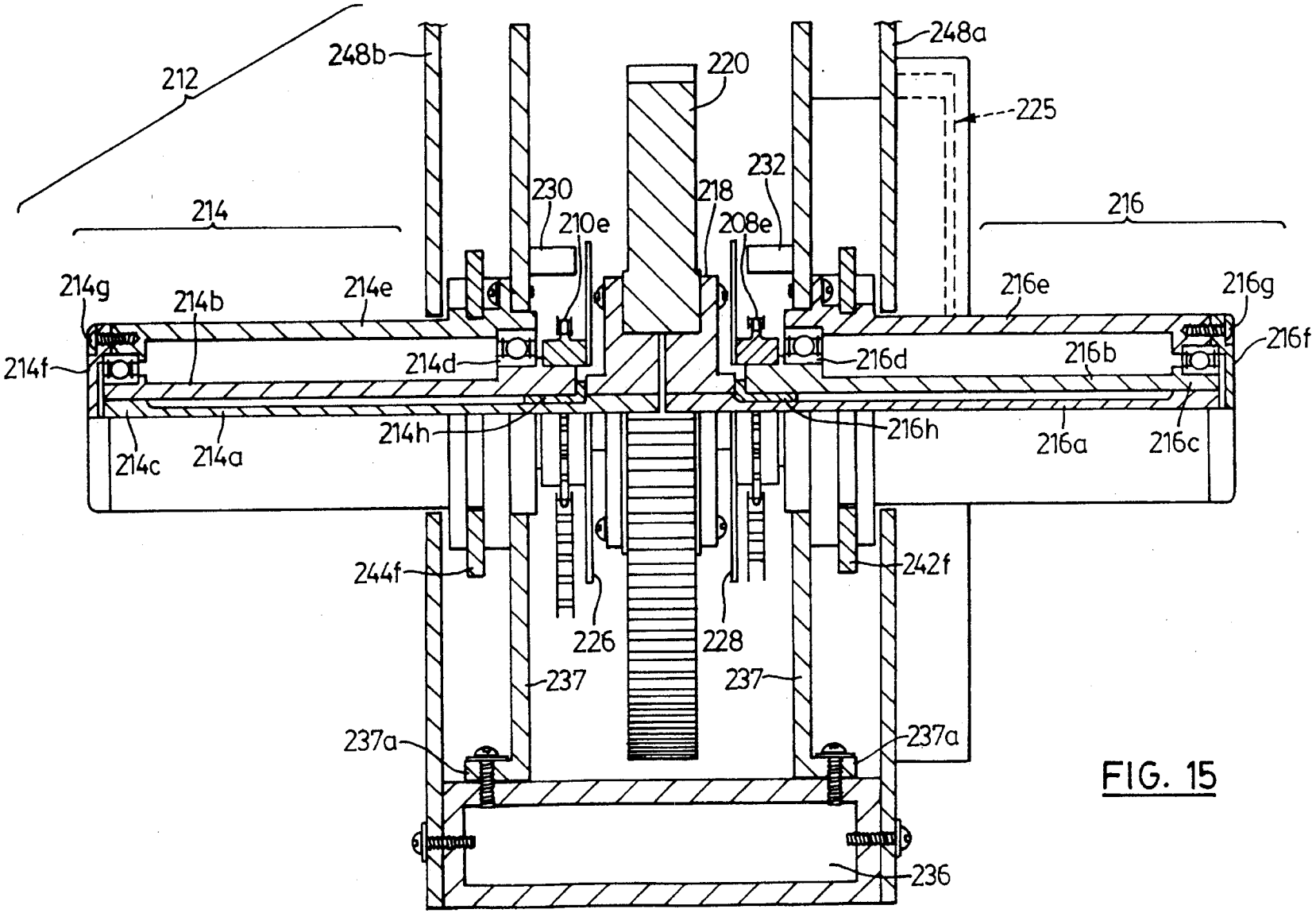
FIG. 15 is a part sectional view taken on line 15—15 of FIG. 11.

Referring to FIG. 15, the driven sprockets 208*e*, 210*e* are mounted on opposite sides of a common load axle assembly 212, in this case in the form of an intermediate drive assembly. The assembly 212 has a pair of torsion assemblies 214, 216, each having an inner torsional element 214*a*, 216*a* joined to an outer torsional element 214*b*, 216*b* at their remote ends shown at 214*c*, 216*c*. Positioned on the inner and outer ends of each outer torsional element 214*b* are the inner races of a pair of bearing members 214*d*, 216*d* whose outer races are fixed to an outer casing member 214*e*, 216*e*. Each outer casing member 214*e*, 216*e* is further provided with a cap member 214*f*, 216*f* attached thereto by threaded fasteners 214*g*, 216*g*.

The inner torsional elements 214*a*, 216*a* form the support axle of a pair of drive wheel hubs 218. Attached to the hub is a wheel body 220 having a toothed outer profile to receive a timing belt in engagement therewith as shown at 222 (FIG. 12) and joining the wheel body 220 with a second segment 224 of the load assembly 204 (FIG. 12). Thus, the torsion assemblies and the associated components form the common load axle portions for the driven sprockets. Furthermore, each of the common load axle portions has a sufficiently high torsional resiliency to flex independently a measurable predetermined degree under the action of the corresponding transmission member as will be described.

The timing belt 222 is engaged with the wheel body 220 and the second segment 224 in the form of an input to a load device generally shown at 225 (FIG. 12) which may include for example, an electric generator, whose specifications are selected to provide a resistive load when displaced by the timing belt. Alternatively, the load device may include a resistive load of the belt- or load roller-type described in the earlier embodiments, or a hydraulic arrangement such as a recirculating hydraulic pump.

Thus, each of the common load axle portions includes an inner torsional element and an outer torsional element, the inner and outer torsional elements being concentric, the inner and outer torsional elements having respective first ends which are fixed together to transfer torsional forces therebetween, the inner and outer torsional elements having respective second ends, the second end of the inner torsional element being coupled with the common load axle while the second end of the outer torsional element is coupled with the transmission member, for example the driven sprocket 208*e*, 210*e*.

The device 100 is further provided with means for isolating the inner and outer torsional elements from lateral forces exerted by the pulley and timing belt drive. In this case, the means for isolating includes a pair of sleeve bearings, each being in the form of a self-lubricating split sleeve bearing 214*h*, 216*h* provided between the inner and outer torsional elements on each side of the drive wheel hub 218 and maintains concentric location of the torsional elements and makes the bearings 214*d*, 216*d* the actual support for the load, that is by transferring the load through the outer sleeve to the bearing, thereby protecting the inner and outer torsional elements.

Referring to FIGS. 11 and 12, the saddle 202 is positioned on a vertically adjustable saddle support 234 having an upper portion 234*a* which is longitudinally slidably mounted to an intermediate portion 234*b* which in turn is coupled to a lower portion 234*c*, which is joined to a base frame 236 extending the length of the device. The intermediate portion is in the form of a track with the upper portion 234*a* having a slidable coupling with flanges engaged with the track to adjust the position of the saddle relative to the handle bars.

Positioned on the front end of the housing is a front frame member 240 which is fixed to the base frame 236 and has a pair of opposed slots, one of which is shown at 240*a* to provide support for the front end of the drive means in a manner to be described. In addition, a pair of support plates are provided as shown at 237, each with a lower right angled flange 237*a* which is bolted to the upper surface of the base frame member 236. Each support plate extends upwardly along a rear portion of the base frame member and is provided with a central passage to 237*b* to receive a respective outer casing member 214*e*, 216*e*, thereby to support the common load axle assembly 212, while the load device 225 is secured to the left-hand support plate 237.

Referring to FIG. 11, a housing generally shown at 248 is also provided to enclose the device 200 and includes a main housing portion 248*a* and a panel 248*b* removable therefrom. Both the housing portion and the panel are bolted to the base frame member 236 by way of fasteners 248*c* (FIG. 15) and have arcuate passage 248*d* permitting position of the pedal axles 208*c*, 210*c* to be adjusted. The housing also has an end region that terminates against the base frame member at 248*e* as shown in FIG. 12.

Figure 14:
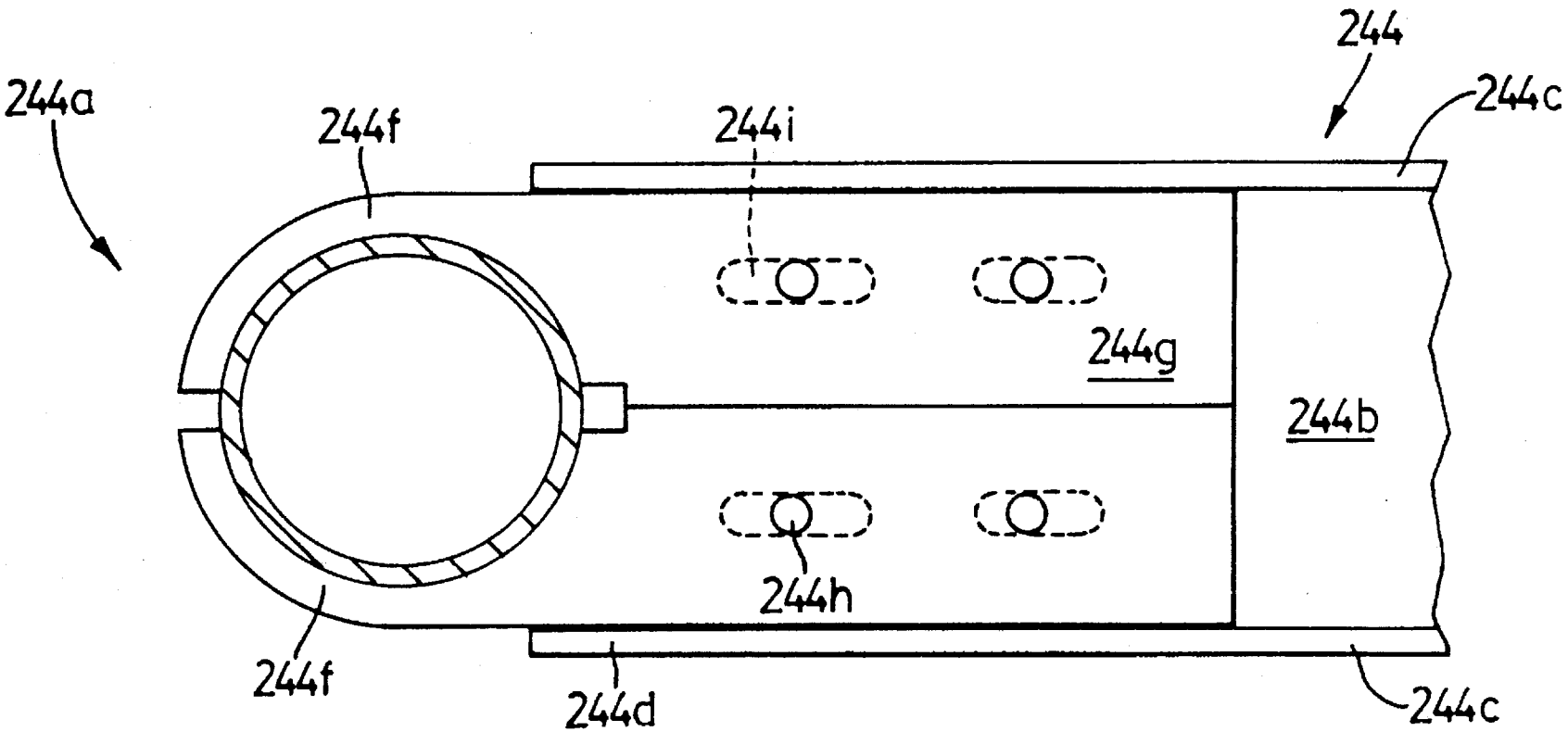
FIG. 14 is a fragmentary part sectional view of a portion of the device illustrated in FIG. 11.

Referring to FIGS. 12 and 14 (the latter showing detail of the drive support frame 244), a pair of independent drive support frames 242, 244 are pivoted to the respective outer casing members 214*e*, 216*e* (FIG. 15) by way of a coupling member, one of which is shown at 242*a* and independently support the pedal mechanisms 208, 210. The drive support frames 242, 244 each have a c-shaped profile with a central web 244*b* and upper and lower webs 244*c*, a rear end 244*d* and a front end 244*e* (FIG. 12). The coupling member 244*a* has a pair of claw members 244*f* which engage opposite faces of the outer casing member and are held together by the upper and lower webs when assembled with the drive support frame. The claw members are further provided with four passages 244*h* to be aligned with slots 244*i* in the web 244*b* to receive threaded fasteners, thereby to allow the coupling member 244*a* to be adjusted relative to the web 244*b*.

Figure 13:
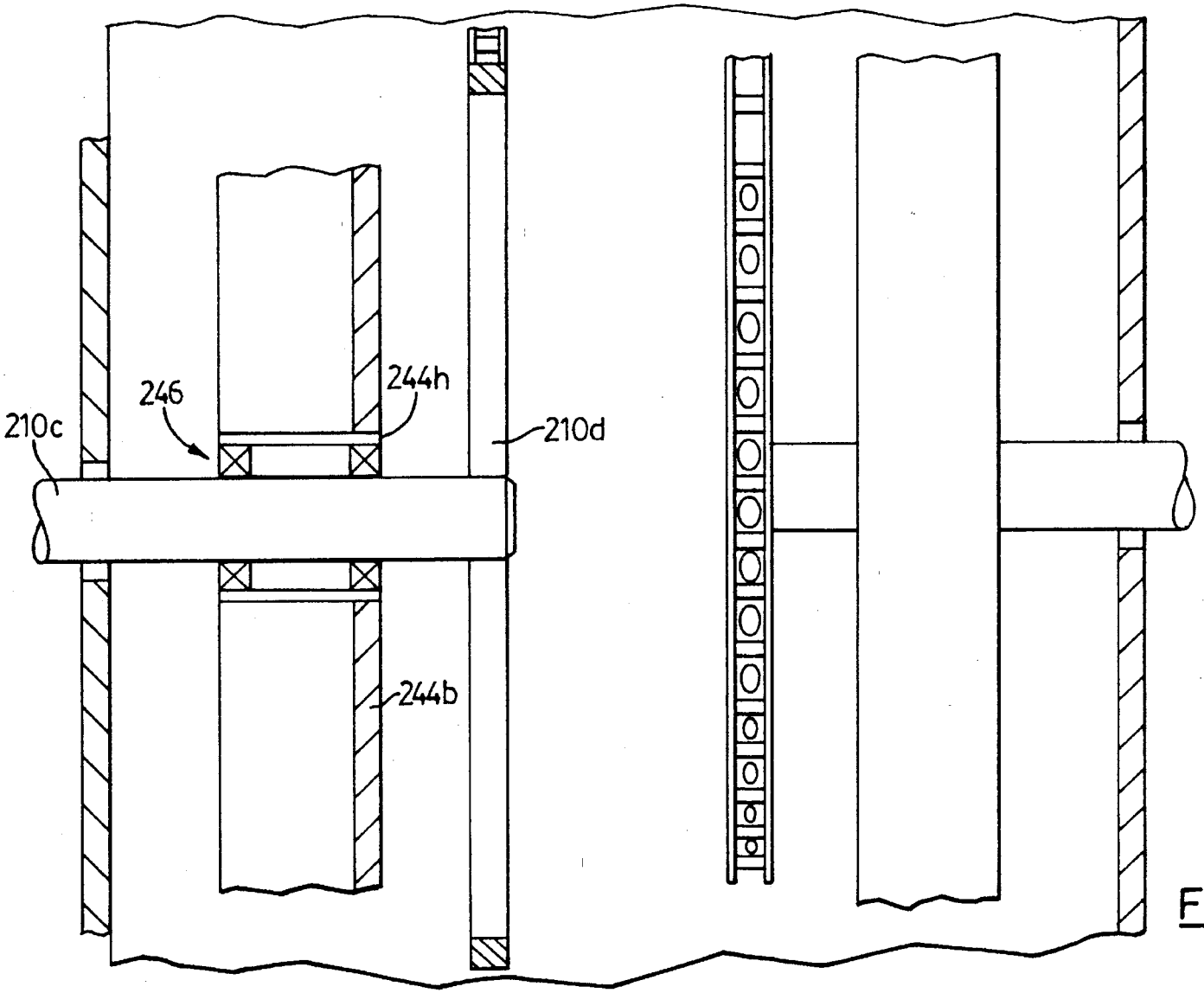
FIG. 13 is a fragmentary sectional view taken on line 13—13 of FIG. 11.

Referring to FIG. 13, each central web 244*b* is further provided with a passage 244*h* to receive a bearing assembly 246 which in turn supports a pedal axle 208*c*, 210*c*, itself fixed for rotation with the drive sprocket 208*d*, 210*d*. Referring to FIG. 12, each drive support frame has a forward extending flange as shown at 242*a*, 244*a* which are aligned with the slot 240*a* to receive a male-female threaded fastener shown at 249, thereby to provide support for the front end of the drive means. Thus, the coupling member 244*a* allows the drive support frame 244 to be length-adjustable to permit the chain to be tightened against the drive and driven sprockets.

Referring to FIG. 15, a pair of sensing means are provided to sense the flexing of a corresponding common load axle portion and a display means is provided for displaying such things as the power being delivered by each of the patient's legs. The sensing means includes a pair of discs each associated with a respective common load axle portion, and a register means for registering rotation of the disc according to a neutral reference point. In this case, the discs are provided at 226, 228 and are fixed to the inside face of each of the driven sprockets 208*e*, 210*e* and each disc 226, 228 is provided with a number of delineations, either in the form of one or more passages, alternating patterns or the like, as is known to those skilled in the art.

Positioned adjacent each disc and mounted on a respective support plate 237 is a motion sensor 230, 232 (which may be optical, magnetic, inductive, capacitive or the like) which is arranged to detect delineations in the disc each time the disc passes the stationary motion sensor.

Figure 16:
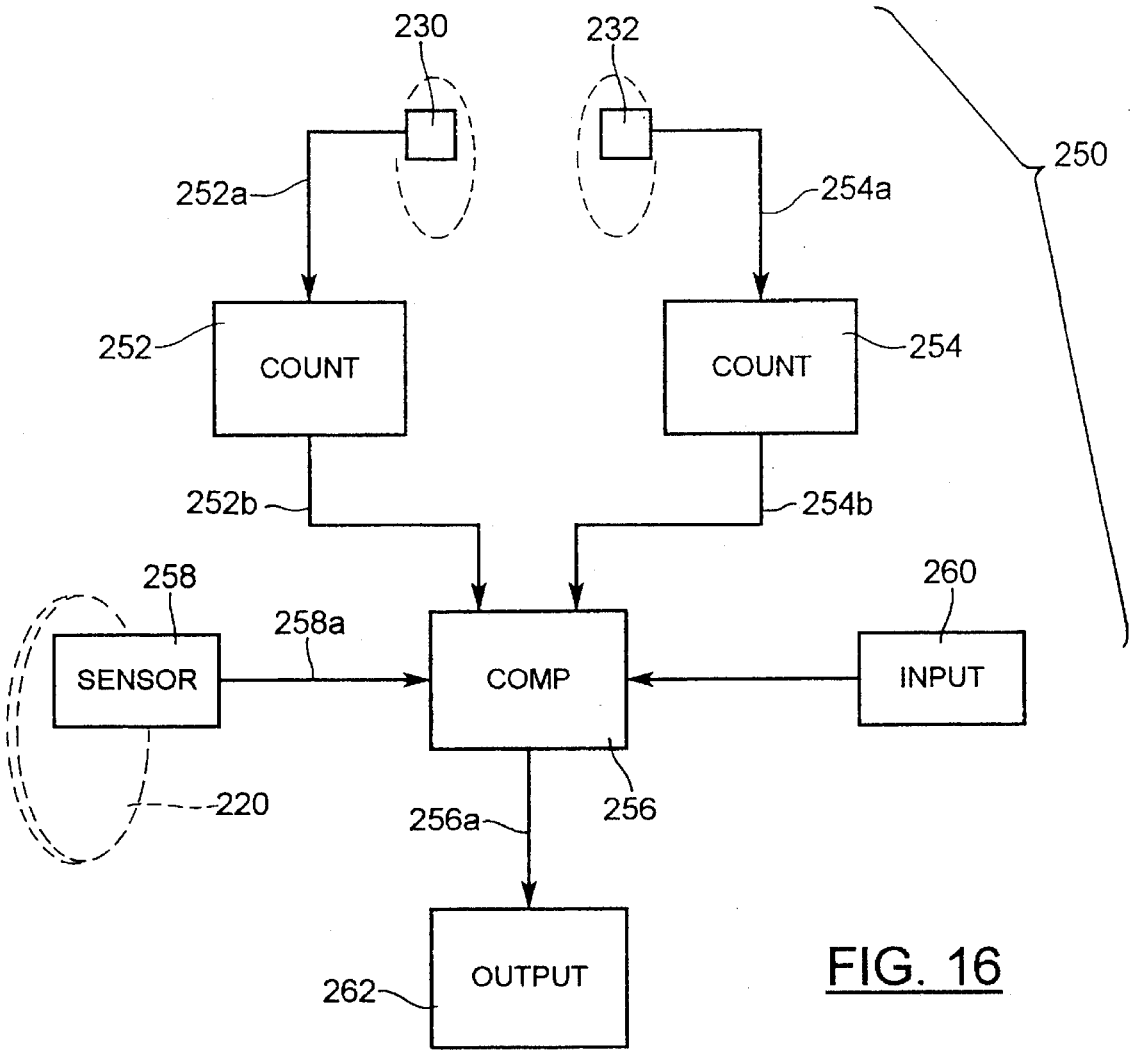
FIG. 16 is a schematic view of another portion of the device illustrated in FIG. 11.

Referring to FIG. 16, a monitoring unit is illustrated at 250 to monitor the power delivered by patient on the device shown in FIG. 11. The monitor 250 includes a pair of counters 252, 254 which receive signals from the motion sensors 230, 232 on paths 252*a*, 254*a* respectively. Receiving signals from the counters 252, 254 on paths 252*b*, 254*b* is a computation unit 256. A motion sensor may also, if desired, be provided at 258 for sensing the motion of the drive wheel 220 and conveys signals thereof to the computation unit 256 on path 258*a*, though this information may be available from the signals received from sensors 230, 232. Also provided is an input device 260 which stores values for each of the parameters of the device.

Figure 17:
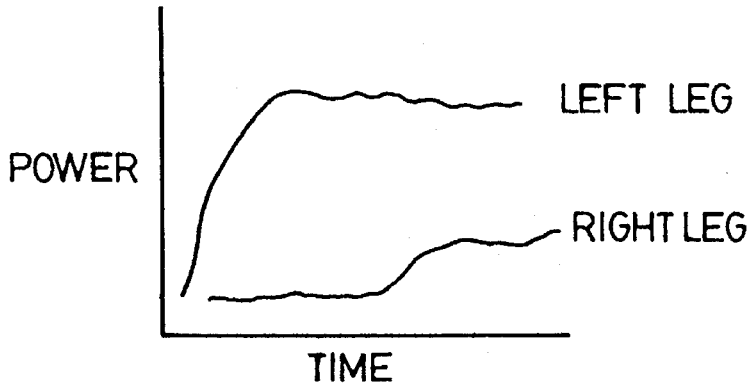
FIG. 17 is a plot of output values from the device illustrated in FIG. 11.

The input device 260 conveys signals relating to the values of the parameters to the computation unit 256 which in turn may calculate, among other things, the power being delivered to the device by each of the patient's legs and conveys this data to an output device 262 on path 262*a* to present the data in some recognizable form such as a power time graph for each leg, as shown in FIG. 17.

Thus, the monitoring unit includes input means for inputting parameters of the patient; memory means for storing the parameters, and a calculation means for making performance calculations as will be discussed.

The device 200 may be used in the following manner. First, like the earlier embodiments, the device is adjusted to accommodate the needs of the patent, using again the parameters of the patient set out earlier, by adjusting the left pedal mechanism higher than the right, perhaps with the left pedal being positioned relatively close to its respective pedal axis. In addition, the monitoring unit may be configured to record certain parameters of the device, such as position of left pedal, position of right pedal, and height of the seat. In addition, the monitoring unit may be configured to record certain parameters of the patient such as body weight, leg length and the like, and perhaps certain milestones such as peak breathing rate, pulse, instantaneous power and the like.

With the seat, the handle bar and the load resistance set, the patient may then be installed on and be encouraged to pedal the device. The monitoring unit may then be activated to track the performance of the patient and make certain performance calculations which might include for example:

forces exerted by each foot on the corresponding pedal;

pedal rotation speed;

total load energy;

knee bending angles; and angle ranges during a rotation of the corresponding pedal.

Thus, as the patient operates the device (again using the earlier example) more power may be delivered to the right hand load axle portion than the left. In this case, the independent flexing of the right hand load axle portion is greater than the left hand counterpart. The greater the power being delivered by the strong leg as compared to the weak leg, the greater the lead of the corresponding disc. As a result, the sensors pick up the deflection and convey signals to the monitoring unit, which in turn calculates the power being produced by each leg. The monitoring unit can then track the exercise activity and track the power being produced at successive time increments and trace a power/time curve as shown in FIG. 17.

While the monitoring unit has been discussed with respect to the device 200, the monitoring unit may be useful as an electronic aid to other devices which provide therapeutic exercise, wherein the monitoring unit may provide for patient parameter input as well as a patient performance output display while also providing an input to enter a present range of performance parameters.

We claim:

1. A foot operated therapeutic exercise device comprising;

a saddle, a load and drive means to propel said load;

said drive means further including a pair of pedal mechanisms, each of said pedal mechanisms including a pedal and a pedal support, said pedal support being mounted for rotation about a pedal axis;

a pair of coupling means, each to independently couple a corresponding one of said pedals to said support in a manner to allow the position of said pedal to be adjusted relative to said pedal axis, according to the range of motion of a corresponding knee of a patient;

adjustment means to independently adjust the pedal axis of each of said pedal mechanisms relative to said saddle, according to the corresponding leg of the patient, thereby allowing the exercise regimen for each leg to be adjusted according to its individual limitations.

2. A device as defined in claim 1 wherein the pedal axis of each pedal mechanism is provided by a discrete pedal axle.

3. A device as defined in claim 2 wherein each of said pedal supports includes an arm, said arm having one end which is fixed to said discrete pedal axle.

4. A device as defined in claim 3 further comprising pedal coupling means to rotatably couple said pedal to said arm thereby to follow a radius of curvature about said axis, said pedal coupling means allowing the position of said pedal to be varied along said arm.

5. A device as defined in claim 4 further comprising a frame to support said saddle, said load and said drive means; a pair of adjustable mounting means, each for mounting a respective one of said pedal supports to said frame, said adjustable mounting means permitting said pedal supports to be independently adjusted relative to said saddle.

6. A device as defined in claim 5 wherein said drive means further comprises a common load axle, each of said pedal mechanisms further include one of a pair of transmission members to deliver power from each of said pedal mechanisms to said common load axle.

7. A device as defined in claim 6 wherein said common load axle further comprises a pair of common load axle portions, each of which is coupled to a corresponding transmission member.

8. A device as defined in claim 7 wherein each of said common load axle portions has a sufficiently high torsional resiliency to flex independently a measurable predetermined degree under the action of the corresponding transmission member.

9. A device as defined in claim 8 further comprising a pair of sensing means, each to sense the flexing of a corresponding common load axle portion, and display means for displaying the degree of flexing.

10. A device as defined in claim 9 wherein said sensing means includes a pair of discs each associated with a respective common load axle portion, and register means for register rotation of said disc according to a neutral reference point.

11. A device as defined in claim 10 further comprising controller means in communication with each of said register means for making independent performance calculations for each leg.

12. A device as defined in claim 11 wherein said controller means includes input means for inputting parameters of said patient; memory means for storing said parameters, and a calculation means for making performance calculations.

13. A device as defined in claim 8 wherein each of said common load axle portions includes an inner torsional element and an outer torsional element, said inner and outer torsional elements being concentric, said inner and outer torsional elements having respective first ends which are fixed together to transfer torsional forces therebetween, said inner and outer torsional elements having respective second ends, the second end of the inner torsional element being coupled with said common load axle while the second end of the outer torsional element is coupled with said transmission member.

14. A device as defined in claim 13 wherein each of said transmission members includes a chain, a first sprocket mounted on said pedal support and a second sprocket mounted on the second end of said outer torsional element, said device further comprising means for isolating said torsional elements from lateral forces exerted by said pulley and timing belt drive.

15. A device as claimed in claim 14 wherein said means for isolating includes a pair of sleeve bearings positioned between said inner and outer torsional elements.

* * * * *